United States Patent [19]

Vokurka

[11] 4,208,661

[45] Jun. 17, 1980

[54] ANTENNA WITH TWO ORTHOGONALLY DISPOSED PARABOLIC CYLINDRICAL REFLECTORS

[76] Inventor: Václav J. Vokurka, 18, Van Hallstraat, Son en Breugel, Netherlands

[21] Appl. No.: 813,245

[22] Filed: Jul. 6, 1977

[30] Foreign Application Priority Data

Jul. 22, 1976 [NL] Netherlands ..... 7608162

[51] Int. Cl.[2] ..... H01Q 19/18

[52] U.S. Cl. ..... 343/781 P; 343/840

[58] Field of Search ..... 343/781 P, 837, 840, 343/781 CA

[56] References Cited

U.S. PATENT DOCUMENTS

| | | | |
|---|---|---|---|
| 2,825,063 | 2/1958 | Spencer | 343/775 |
| 2,846,680 | 8/1958 | Lewis | 343/837 |
| 2,870,441 | 1/1959 | Hines | 343/781 P |
| 3,029,431 | 4/1962 | Miller | 343/837 |
| 3,792,480 | 2/1974 | Graham | 343/781 CA |

*Primary Examiner*—Eli Lieberman

*Attorney, Agent, or Firm*—Watson, Cole, Grindle & Watson

[57] ABSTRACT

An antenna set-up comprising a first and a second reflector in the form of substantially parabolic cylinder surfaces and a feed source, directed to the first reflector and placed on the focal line of that reflector and in which set-up the directrix of the cylindrical wave front obtained by exposure of the first reflector coincides with the focal line of the second reflector and the focal line of the first reflector is not parallel to the symmetry plane of the second reflector.

3 Claims, 3 Drawing Figures

ANTENNA WITH TWO ORTHOGONALLY DISPOSED PARABOLIC CYLINDRICAL REFLECTORS

BACKGROUND OF THE INVENTION

The invention relates to an antenna set-up comprising a first and a second reflector in the form of substantially parabolic cylinder surfaces and a feed source directed to the first reflector and placed on the focal line of that reflector and in which set-up the directrix of the cylindrical wave front obtained by exposure of the first reflector coincides with the focal line of the second reflector.

Such an antenna is known from the US-magazine "IRE Transactions Antennas and Propagation", Volime AP-3 No. 1 January 1955, Article by R. C. Spencer et al: "Double-Parabolic Cylinder pencil-beam antenna", pp. 4–8.

The antenna described in this literature reference has the drawback that the feed source is situated in the reflective beam on the surface of the second reflector and as a result exerts a disturbing effect on that beam.

U.S. Pat. No. 3,938,162, which describes a variable beam-width antenna of such a type, admittedly prevents the above drawback by placing the feed source on the edge of the second reflector out of reflective reach of the first reflector, but as a result in turn has the drawback that part of the second reflector cannot be used.

SUMMARY OF THE INVENTION

It is the object of the invention to put an end to the above drawbacks and, therefore, it is characterized in that the focal line of the first reflector is not parallel to the symmetry plane of the second reflector.

The invention makes use of the insight that the reflectors can be rotated in respect of each other around the directrix without the optical properties of the system being affected.

Then the feed source and the reflectors can be positioned in respect of each other in such a way that a disturbance of the beam to be received or to be emitted by one or more of them need not take place any longer.

DESCRIPTION OF A PREFERRED EMBODIMENT

Figure 1:
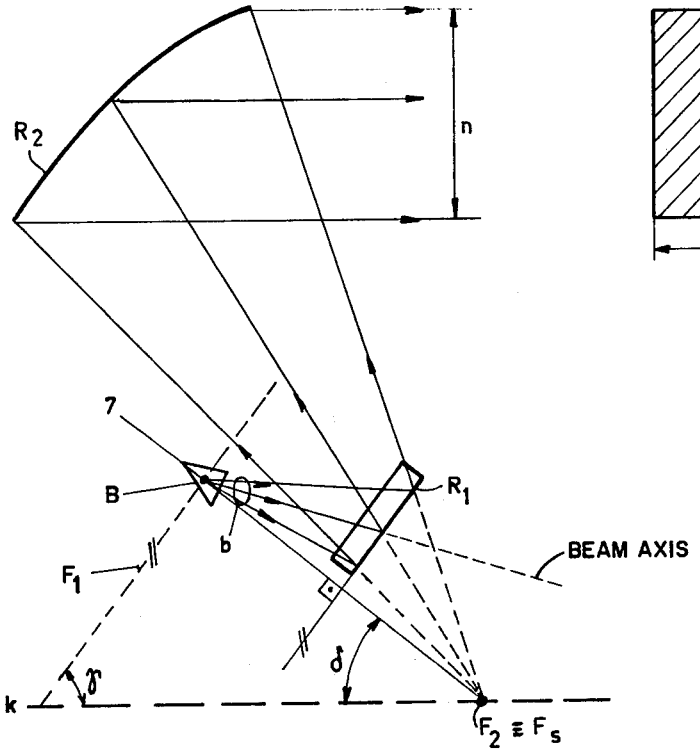

The invention will now further be elucidated with reference to a drawing with three figures.

In the drawing:

FIG. 1 represents: An antenna set-up in upper view according to an embodiment of the invention.

Figure 2:
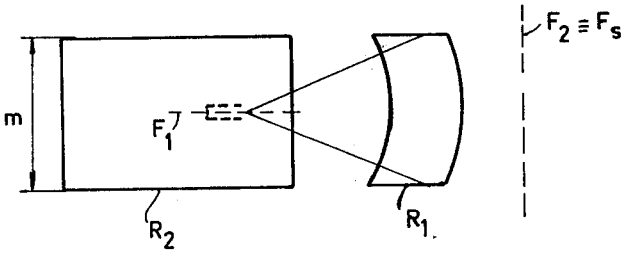

FIG. 2: The set-up of FIG. 1 in side view and

Figure 3:
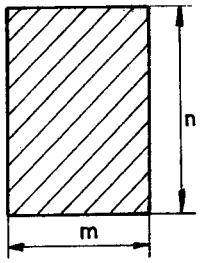

FIG. 3: A section of the emitted beam.

In the Figures like ciphers and letters refer to like elements. In FIG. 1 feed source B is placed on focal line $F_1$ of reflector $R_1$, which has the form of a parabolic cylinder surface. Beam of rays b emitted by feed source B into the direction of reflector $R_1$ is reflected as if coming from directrix $F_s$, which is situated in symmetry plane k of reflector $R_2$. Focal line $F_2$ of reflector $R_2$, which reflector has a parabolic cylinder surface, coincides with directrix $F_s$, causing the incident diverging beam on reflector $R_2$ to leave this reflector $R_2$ parallel to symmetry plane k.

The parallel beam incident on reflector $R_2$ is parallel in the view as drawn in FIG. 2 and remains so after reflection against the surface of reflector 2. FIG. 3 shows the section of the beam radiated by reflector $R_2$.

In FIG. 1, furthermore, is shown that focal line $F_1$ of first reflector $R_1$ is not parallel to symmetry plane k of second reflector $R_2$ but makes an angle with it, $\gamma=90°-\delta$, $\delta$ being unequal to 90°.

I claim:

1. An antenna system, comprising:

first and second reflectors in the form of substantially parabolic cylindrical surfaces and having respective first and second focal lines and first and second symmetry planes, said first focal line being skewed with respect to said second symmetry plane and said first and second symmetry planes being crossed with one another; the directrix of said first reflector being coincident with said second focal line in said second plane of symmetry, a point feed source directed towards said first reflector having a phase center and located on said first focal line, said feed source have an axis disposed at an angle other than 90° from said first focal line so as not to cast a shadow on said second reflector; and whereby the apparent line source of the cylindrical wave front produced by illumination of said first reflector coincides with said second focal line.

2. An antenna system, comprising:

first and second reflectors in the form of substantially parabolic cylindrical surfaces and having respective first and second focal lines and respective first and second symmetry planes, said first and second symmetry planes being crossed with respect to one another; the directrix of said first reflector being coincident with said second focal line in said second plane of symmetry, said first focal line being skewed with respect to said second symmetry plane;

A point feed source directed towards said first reflector and located on said first focal line, said feed source having an axis which is disposed at an angle other than 90° from said first focal line and which is lying in said first symmetry plane so as not to cast a shadow on said second reflector;

whereby the apparent line source of the cylindrical wave front produced by illumination of said first reflector coincides with said second focal line.

3. An antenna system, comprising:

first and second reflectors in the form of substantially parabolic cylindrical surfaces and having respective first and second focal lines and respective first and second symmetry planes crossed with one another; the directrix of said first reflector being coincident with said second focal line in said second plane of symmetry, said first focal line being skewed with respect to said second symmetry plane;

a point feed source directed towards said first reflector having a phase center located on said first focal line, said feed source having an axis which is disposed at an angle other than 90° from said first focal line and which is being skewed with respect to said symmetry plane so as not to cast a shadow on said second reflector; and whereby the apparent line source of the cylindrical wave front produced by illumination of said first reflector coincides with said second focal line.

* * * * *